US009527709B2

(12) United States Patent
Zamorano Jones et al.

(10) Patent No.: US 9,527,709 B2
(45) Date of Patent: Dec. 27, 2016

(54) OVERTURNING EQUIPMENT FOR HOPPERS

(71) Applicant: Minetec S.A., Renca, Santiago (CL)

(72) Inventors: Claudio Zamorano Jones, Renca (CL); Eduardo Vasquez Hauva, Renca (CL); David Quezada Navarrete, Renca (CL)

(73) Assignee: Minetec S.A., Santiago (CL)

( * ) Notice: Subject to any disclaimer, the term of this patent is extended or adjusted under 35 U.S.C. 154(b) by 440 days.

(21) Appl. No.: 13/974,412

(22) Filed: Aug. 23, 2013

(65) Prior Publication Data

US 2014/0201963 A1 Jul. 24, 2014

(30) Foreign Application Priority Data

Jan. 24, 2013 (CL) ..... 0239-2013

(51) Int. Cl.
*B25B 11/00* (2006.01)
*B66F 9/02* (2006.01)

(52) U.S. Cl.
CPC ..... *B66F 9/02* (2013.01); *Y10T 29/49718* (2015.01)

(58) Field of Classification Search
CPC ..... B66F 5/00; B66F 7/04; B66F 7/08; B66F 9/07536; B66C 23/48; B62B 3/0631
See application file for complete search history.

(56) References Cited

U.S. PATENT DOCUMENTS 4,599,034 A * 7/1986 Kennedy ..... B66F 7/025 254/89 R
7,448,606 B1 * 11/2008 Johnson ..... B05B 13/0285 269/16
8,245,856 B1 * 8/2012 Pappin ..... A63H 17/00 211/13.1
8,596,627 B2 * 12/2013 Lands ..... B25H 1/0007 254/2 B
2001/0048188 A1 * 12/2001 DuVernay ..... B25H 1/0007 269/17
2003/0062663 A1 * 4/2003 Fox ..... B25H 1/0007 269/17
2014/0201963 A1 * 7/2014 Zamorano Jones ..... B66F 9/02 29/402.01

FOREIGN PATENT DOCUMENTS

| | | |
|---|---|---|
| CL | 2430-2003 | 12/2005 |
| CL | 1876-2007 | 5/2008 |
| CL | 2638-2008 | 9/2008 |
| CL | 2637-2008 | 6/2009 |
| CN | 102030292 | 4/2011 |

* cited by examiner

*Primary Examiner* — Lee D Wilson
(74) *Attorney, Agent, or Firm* — Hamre, Schumann, Mueller & Larson, P.C.

(57) ABSTRACT

A pyramid-shaped tower apparatus is described that will raise and turn mining hoppers for easy access to the areas or elements that need to be maintained or repaired.

9 Claims, 3 Drawing Sheets

OVERTURNING EQUIPMENT FOR HOPPERS

FIELD OF APPLICATION OF THE INVENTION

The present invention relates to the field of maintenance and repair of mining equipment, specifically in the field of repair of mining dump-trucks.

PRIOR STATE OF THE ART

In on-site repairing and maintaining mining equipment hoppers, the use of high tonnage cranes to lift, rotate or turn said hoppers during welding work or while replacing elements in different parts of the hopper, is presently required. This makes site maintenance of this kind of hoppers slow and expensive as it involves hiring cranes, the time of arrival of the crane to the site and the subsequent time spent in securing cables and cable slings or engaging elements in the hopper for lifting, rotating or overturning thereof, in addition to the risks of poor mooring that could cause accidents and material losses.

There are in the state of the art patent applications such as Chilean applications numbers 2430-2003, 1876-2007, 2637-2008, and 2638-2008, which address the issue of lifting and raising the hoppers to be replaced on a truck or for their repair by using columns and hydraulic equipment. These solutions allow to raise and lower the hopper for it to be repaired without fully overturning the hopper. Another disadvantage of this apparatus is the time taken to place and secure the lifting columns of the apparatus and the risk of the hopper's falling down due to poor installation of the racks and columns.

There is also Chinese application CN102030292 which discloses a structure allowing to rotate 180 degrees a large and heavy piece of equipment, thus allowing operators to work both at the bottom and inside of the equipment. The inconvenience observed in this invention is that the piece to be repaired must be previously assembled since no lifting mechanism nor a mechanical or hydraulic mechanism allowing to rotate the equipment to be repaired is observed.

SUMMARY OF THE INVENTION

The present invention consists of a dismountable and mobile system at the same place where the mining activities are performed, preventing the hoppers from being moved to other locations where the required maintenance and repair are performed. The system allows the hopper to be raised from the ground and to be rotated at 360°, with substantial costs savings since hiring cranes being able to reach the location to turn the hopper is not required. On the other hand, it also brings operational time savings since operations often cannot start until the arrival of the crane and mooring and securing the hopper adequately for its raising and overturning and fastening is also time-consuming. In addition, the fastening elements between the towers allow a fast and secure fastening requiring no supports between the ground and the hopper.

DETAILED DESCRIPTION OF THE INVENTION

Figure 1:
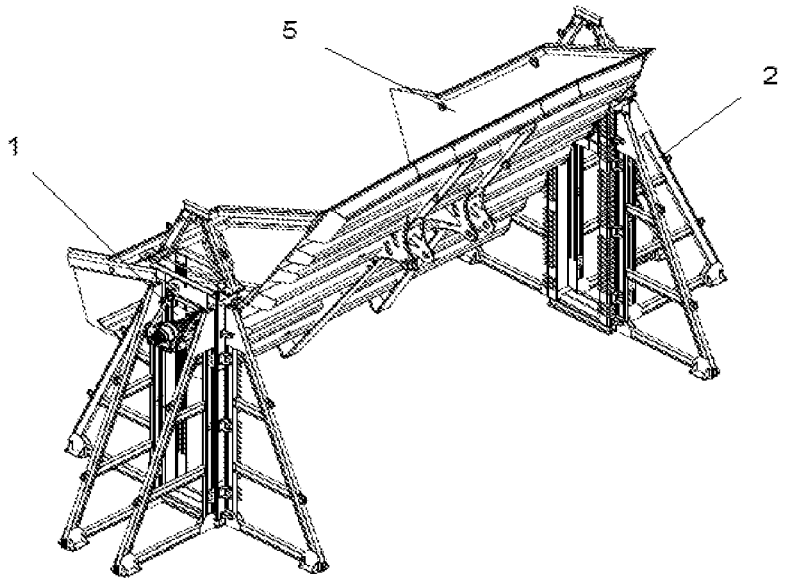
FIG. 1 is an isometric view of the overturning apparatus with a hopper installed.
Figure 2:
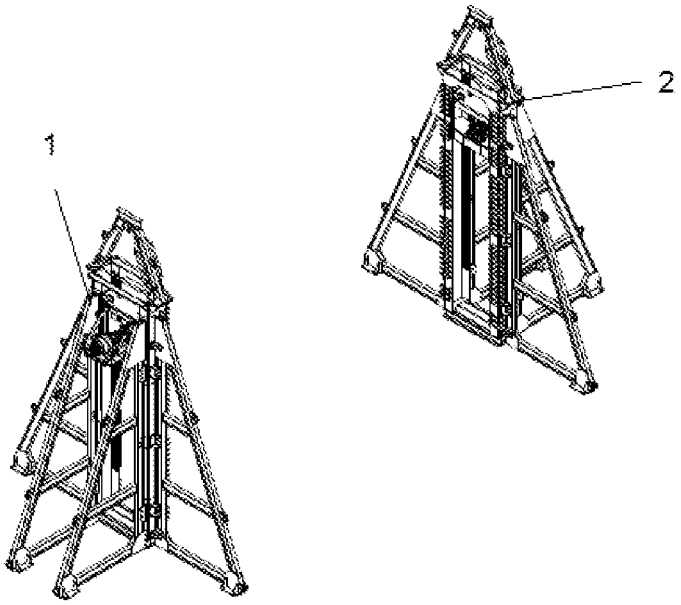
FIG. 2 is an isometric view of the overturning apparatus without the hopper.
Figure 3:
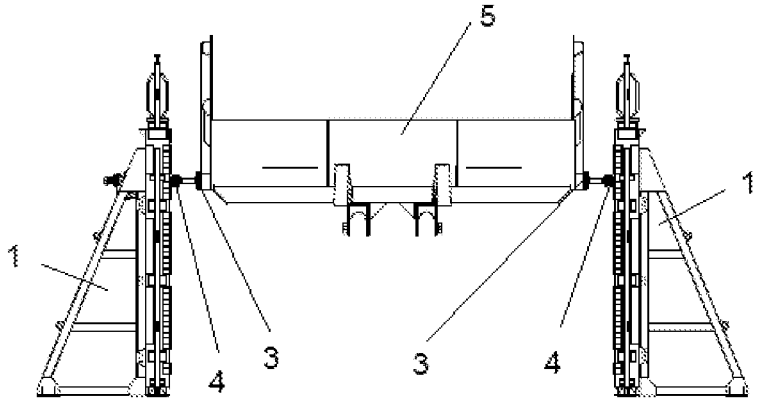
FIG. 3 is a front view of the overturning apparatus with the hopper.
Figure 4:
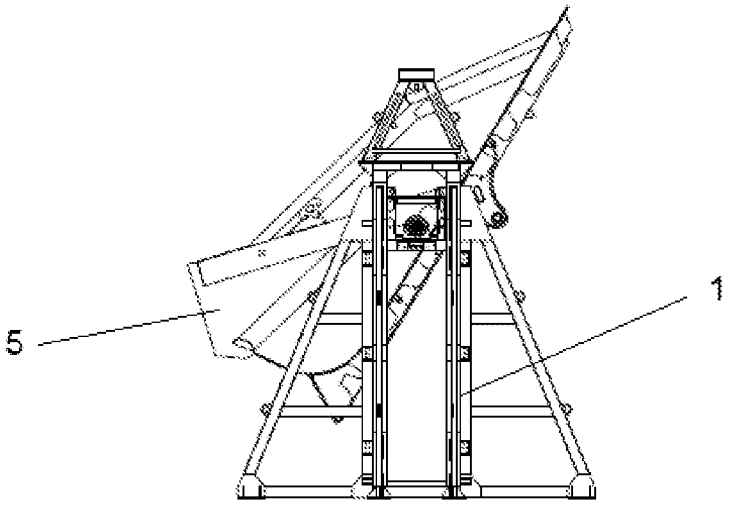
FIG. 4 is a side view of the overturning apparatus with a hopper installed.
Figure 5:
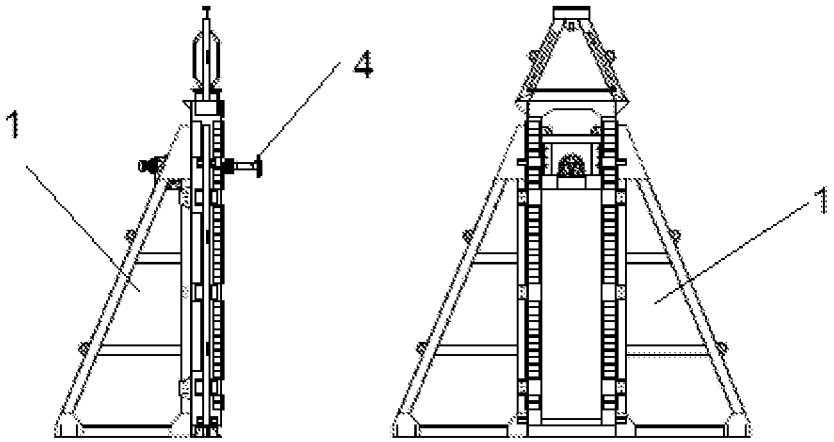
FIG. 5 is a front and side view of tower A
Figure 6:
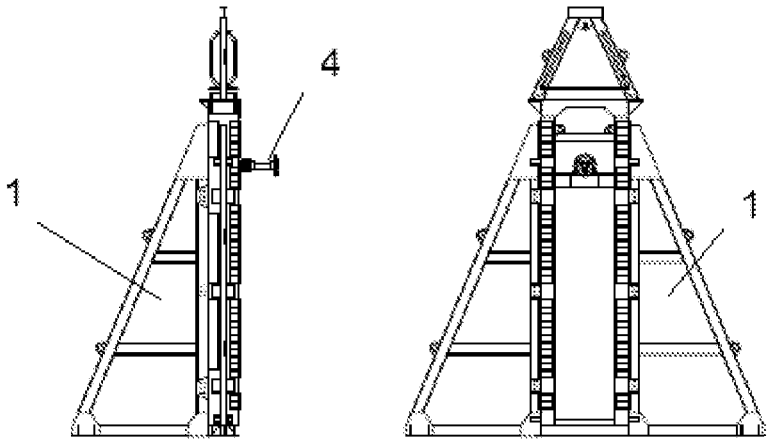
FIG. 6 is a front and side view of tower B

The apparatus intended to raise and turn mining hoppers is comprised of a dismountable, structural, dismountable, pyramid-shaped tower A (1) and a tower B (2) having mobile elements at both towers (1,2) which allow to raise the hopper off the ground (5) up to a specified height and rotate it to a position allowing easy access to the areas or elements to be maintained or repaired. The overturning apparatus joins the hopper by using attachable mechanical fastening means (3,4) made up of a first part (3) that is fixed on the hopper and a second part (4) that is in each one of the towers and rotates, said fastening means being of an attachable and mechanical kind (3,4) for example, Plates or Flanges, the hopper (5) getting joined to the towers (1,2) on both sides, which allows raising thereof. The first part (3) of the attachable mechanical fastening means (3,4) is preferably located as close as to the point equivalent to the center of gravity of the hopper as possible. During the raising of hopper (5) up to the desired height, the second part (4) of the mechanical attachable fastening means (3,4) remain without any rotating capacity once the height at which the hopper (5) can be lifted has been reached, without touching the ground (5), the rotating mechanism of the second part (4) of said attachable mechanical fastening means (3,4) activate. The second part (4) of the attachable mechanical fastening means (3,4) rises and spins on the towers by moving means allowing, in turn, to raise and rotate the hopper (5). Once turned, the hopper (5) may remain fixed at a proper height and angular position to work thereon. The hopper overturning apparatus has hydraulic or electrical safety mechanisms that prevent the hopper from falling down accidentally. The overturning apparatus also has raising mechanisms allowing to lift the hopper and which can mechanical, electrical or hydraulic.

Below is disclosed a method for using the apparatus, comprising the steps of:

a) Providing a level surface area;

b) Providing two dismounted structural towers (1,2) with second parts of the mechanical fastening elements (3,4), raising and overturning mechanisms and with safety systems;

c) Assembling the two towers (1,2) on the level surface area;

d) Locating between the two towers (1,2) a hopper (5), wherein said hopper (5) has, on each side, a first part of a attachable mechanical fastening element (3) to the second parts of the mechanical fastening elements (4) of the towers;

e) Bolting the second parts of the mechanical fastening elements (4) to the first parts of the mechanical fastening elements (3);

f) Raising the hopper (5) up to a desired height or to a height as allowed by the overturning;

g) Overturning the hopper (5); and h) Repairing the hopper (5).

What is claimed is:

1. A truck hopper repair system for repairing a truck hopper that is mounted on the truck hopper repair system, comprising:

first and second towers, each tower formed by a support framework that has a support base and an upper portion that extends vertically upward from the support base to a top end;

each tower includes a tower fastener disposed thereon, each tower fastener is actuatable up and down on the tower in a vertical direction relative to the support framework between a lowered position and a raised position;

each tower fastener is also rotatable about an axis that is perpendicular to the vertical direction;

the support framework of each of the first and second towers includes:

a first frame portion oriented in a substantially vertical plane with a first side that faces in a first direction and a second side that faces in a second direction; and a pair of right angle frame portions that are connected to the first frame portion on the second side thereof; the right angle frame portions extend from the second side in the second direction, are spaced apart from one another, and are each oriented in a plane that is substantially perpendicular to the plane of the first frame portions; and the tower fastener of each tower extends from the first side in the first direction;

the truck hopper includes a pair of truck hopper fasteners mounted thereon at opposite sides of the truck hopper, the truck hopper fasteners are mounted at a center of gravity of the truck hopper, and the truck hopper fasteners are detachably engageable with the tower fasteners;

wherein with the tower fasteners located at the lowered position on the respective towers, the truck hopper can be mounted to the first and second towers by connecting the truck hopper fasteners to the tower fasteners, and the truck hopper can be raised vertically by actuating the tower fasteners to the raised position, and the truck hopper can be rotated about the center of gravity thereof by rotating the tower fasteners.

2. The truck hopper repair system of claim 1, wherein each of the first and second towers is pyramid-shaped.

3. The truck hopper repair system of claim 1, wherein for each tower:

the support base is formed by a base section of the first frame portion and a base section of the right angle frame portions; and the upper portion is formed by an upper section of the first frame portion and an upper section of the right angle frame portions.

4. The truck hopper repair system of claim 1, wherein the first and second towers are not directly attached to one another.

5. The truck hopper repair system of claim 1, wherein for each tower, the tower fastener projects beyond the first side of the first frame portion in a direction perpendicular to the vertical direction.

6. The truck hopper repair system of claim 1, wherein for each tower, the tower fastener is rotatable 360 degrees.

7. The truck hopper repair system of claim 1, wherein for each tower, the tower fastener has a first portion of travel from the lowered position toward the raised position where the tower fastener cannot be rotated and a second portion of travel where the tower fastener can be rotated.

8. The truck hopper repair system of claim 1, wherein each tower includes a single tower fastener, and the truck hopper includes only two of the truck hopper fasteners.

9. The truck hopper repair system of claim 1, wherein for each of the first and second towers the tower fastener does not overlap the support base.

* * * * *